United States Patent [19]

Stahlecker

[11] 4,175,370

[45] Nov. 27, 1979

[54] PIECING APPARATUS FOR AN OPEN-END SPINNING MACHINE

[75] Inventor: Fritz Stahlecker, Bad Überkingen, Fed. Rep. of Germany

[73] Assignees: Hans Stahlecker; Fritz Stahlecker, both of Fed. Rep. of Germany

[21] Appl. No.: 912,418

[22] Filed: Jun. 5, 1978

[30] Foreign Application Priority Data

Jun. 22, 1977 [DE] Fed. Rep. of Germany ..... 2728003

[51] Int. Cl.[2] ..... D01H 15/00

[52] U.S. Cl. ..... 57/263

[58] Field of Search ..... 57/34 R, 58.89–58.95, 57/261, 263

[56] References Cited

U.S. PATENT DOCUMENTS

| | | | |
|---|---|---|---|
| 3,810,352 | 5/1974 | Miyazaki et al. | 57/263 |
| 3,892,062 | 7/1975 | Stahlecker et al. | 57/263 |
| 3,962,855 | 6/1976 | Stahlecker | 57/263 |
| 3,987,610 | 10/1976 | Stahlecker et al. | 57/263 |
| 4,041,684 | 8/1977 | Kamp | 57/263 |
| 4,107,957 | 8/1978 | Stahlecker et al. | 57/263 |
| 4,120,140 | 10/1978 | Raasch et al. | 57/263 |

*Primary Examiner*—John Petrakes

*Attorney, Agent, or Firm*—Craig and Antonelli

[57] ABSTRACT

A mobile piecing device is providing for an open-end spinning machine of the type which has a plurality of separate spinning assemblies each having a rotatable storage spool for storing yarn as it is spun. Preferred embodiments of the invention include an auxiliary spool driving wheel for driving the storage spool during piecing operations, as well as a pair of feeding rollers for feeding the yarn to the spinning rotor and back to the spool. In order to prevent/reduce the formation of a loop and kinking of the yarn during the acceleration phase after the initial piecing, due to the different inertia movements of the spool and the thread and feed rollers, preferred embodiments of the invention include supplemental control mechanisms for controlling the course of the yarn between the feed rollers and the spool. In certain preferred embodiments, the driving mechanism for the spool is adjusted to assure corresponding rapid acceleration of the greater inertia spool as for the feed rollers and returning thread. Other preferred embodiments additionally include yarn tensioning means for maintaining a constnt yarn tension, even in the event of a small loop being formed between the feed rollers and the spool.

21 Claims, 9 Drawing Figures

1
2
3
4
5
6
7
8
9
10
11
12
13
14
15
16
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
67
68
69
70
71
72
73
74
75
76
77
78
79
80
81
82
83
84
85
86
87
88
91

83
84
95
96
94
91
93
67
68
69
72
73
74
65
89
33
70
71
66
76

99
100
85
102
98
101
104
107
91
106
81
115
105
108
103
109
72
73
71
74
66
70
65
33

106
110
180
105
B
76
A 114
112
111
105

PIECING APPARATUS FOR AN OPEN-END SPINNING MACHINE

BACKGROUND AND SUMMARY OF THE INVENTION

The invention relates to a piecing device that is mobile along an open-end spinning machine and that can be sequentially presented to the individual assembles of the open-end spinning machine. Piecing devices of the type contemplated by the present invention include means for lifting off a spool from a drive element of the appurtenant spinning assembly and for driving the spool during the piecing operation, including an auxiliary roll that is applied to the spool and that is provided with a drive, and with means for guiding the yarn from and to the spool, comprising a pair of feed rolls with a drive, whose drive is attuned to the drive of the auxiliary roll.

In a known construction of this kind (German Offenlegungsschrift No. 2,361,787) there are difficulties in the running up phase, i.e. when the yarn applied to a sliver ring in a spinning rotor is once more to be drawn off from the spinning assembly and wound. The feed rolls, together with the practically massless yarn very rapidly reach the desired feed velocity, while the winding speed corresponding to this feed velocity is reached with a delay, due, at least partly, to the greater intertial masses involved. Particularly if the spool is relatively full, there is a slippage between the auxiliary roll and the spool, so that the auxiliary roll cannot accelerate the spool in a way corresponding to the acceleration of the delivery rolls with the yarn that is to be fed. In this delayed acceleration of the spool to its winding speed, the yarn tension drops between the pair of feed rolls and the spool in such a way that a loop of yarn is formed there. Because of the spinning twist given to the yarn this has the effect that in the region of the yarn loop the yarn will kink on itself and run to the spool as a kink. This kink on the spool can be very disturbingly noticeable in further processing.

In a known piecing device (German Offenlegungsschrift No. 2,008,142) there is an additional provision that during the piecing process the yarn will still run via the spool drive roll of the spinning assembly in question, which is driven at its normal operating rpm. Since the yarn is not clamped there, it cannot be predicted what effect the drive roll will have on the yarn. Here also there are difficulties in the running up phase, for the reasons that have been indicated, leading to kinking. Here also it is not possible to accelerate the spool in the same way as the pair of feed rolls, so that in this run up phase the yarn tension is removed and a loop is formed.

The invention is intended further to develop a piecing device of the described type which, even in the running up phase, i.e. when the pieced yarn is again to be drawn from the piecing device, it will be ensured that there will be a controlled yarn guiding and the formation of loops and kinks will be avoided. This problem is solved by contemplated embodiments of the invention, in that means are provided which can be supplementarily switched in to influence the course of the yarn in the region between the pair of feed rolls and the auxiliary roll and/or to influence the winding speed.

According to the invention, in many instances it will be sufficient if during the running up phase it be provided that no differences in speed can occur, while in many cases it will also suffice only to control the running of the yarn in the region between the pair of feed rolls and the auxiliary roll during the running up phase. In most cases however, and in the most preferred embodiments of the invention, it will be advantageous to undertake both measures simultaneously, i.e. to influence the increase in the winding speed and at the same time to provide an additional yarn guide during the running up phase.

In an advantageous embodiment of the invention, it is provided that the supplementary means are connected to a program control that controls the whole work sequence, which will determine the time of switching in and/or the duration of the switching in.

To accelerate the increase in winding speed so that the slippage between the auxiliary roll and the spool will be reduced, in a simple embodiment of the invention, a loading device is provided that presses the spool against the auxiliary roll during the running up phase.

In order, during the running up phase, to be able to influence the course of the yarn, a yarn storage device is disposed between the pair of feed rolls and the auxiliary roll, which storage device accepts the yarn that is fed but not wound during the running up phase, in case of differences between the feed velocity and the winding speed. Such a yarn storage device can be further exploited, in that it participates in the preparatory process by forming a yarn reserve which is released in the carrying back of the yarn into a spinning rotor, so that in this case the auxiliary roll no longer needs to be driven against the drawoff device, shortly before the running up phase.

These and further objects, features and advantages of the present invention will become more obvious from the following description when taken in connection with the accompanying drawings, which show, for purposes of illustration only, several embodiments in accordance with the present invention.

DETAILED DESCRIPTION OF THE DRAWINGS

Figure 1:
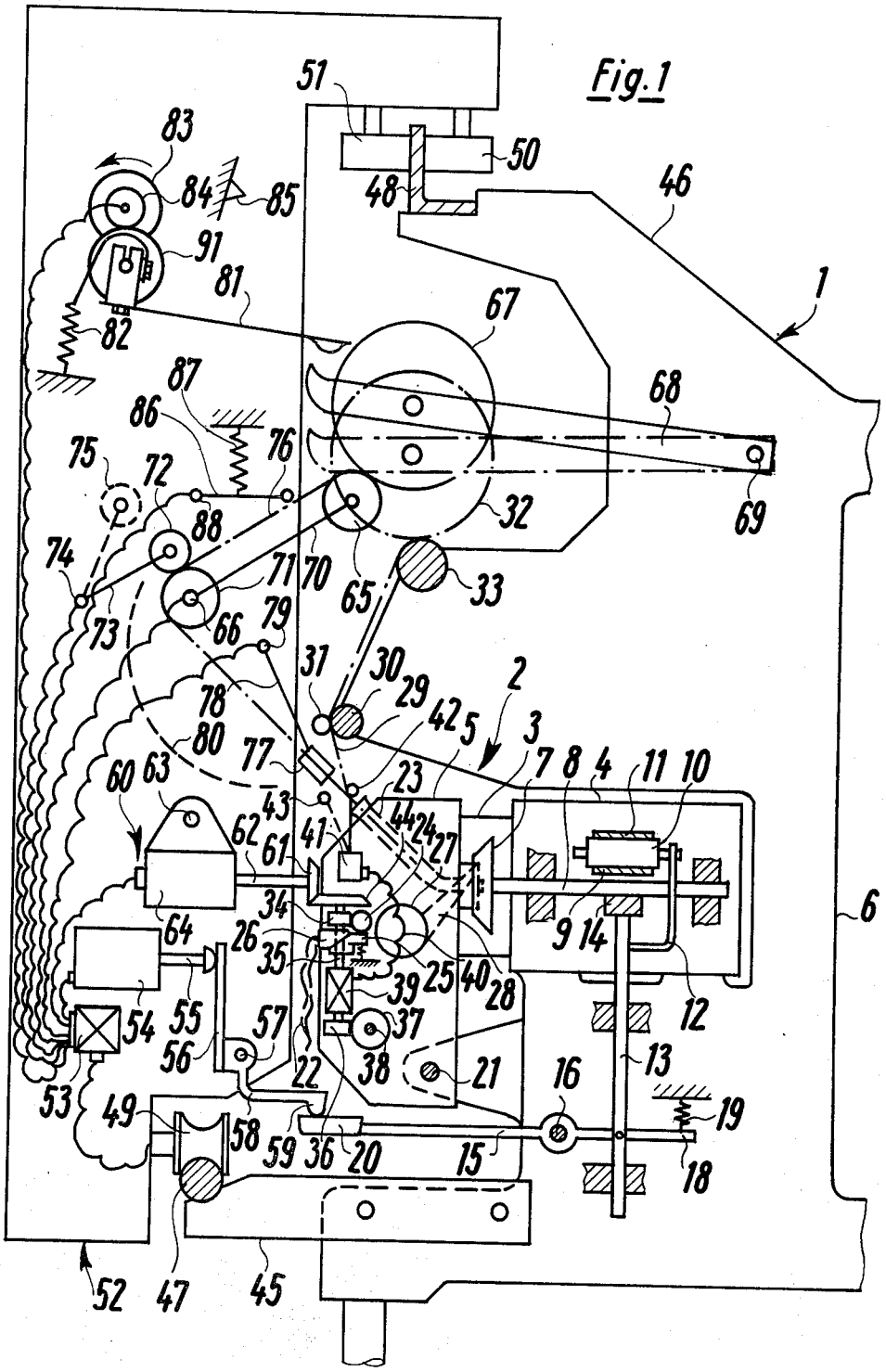
FIG. 1 is a schematic part-sectional view through an open-end spinning machine in the zone of a spinning assembly and a mobile piecing device that can be presented to the said spinning assembly, constructed in accordance with a preferred embodiment of the invention.
Figure 3:
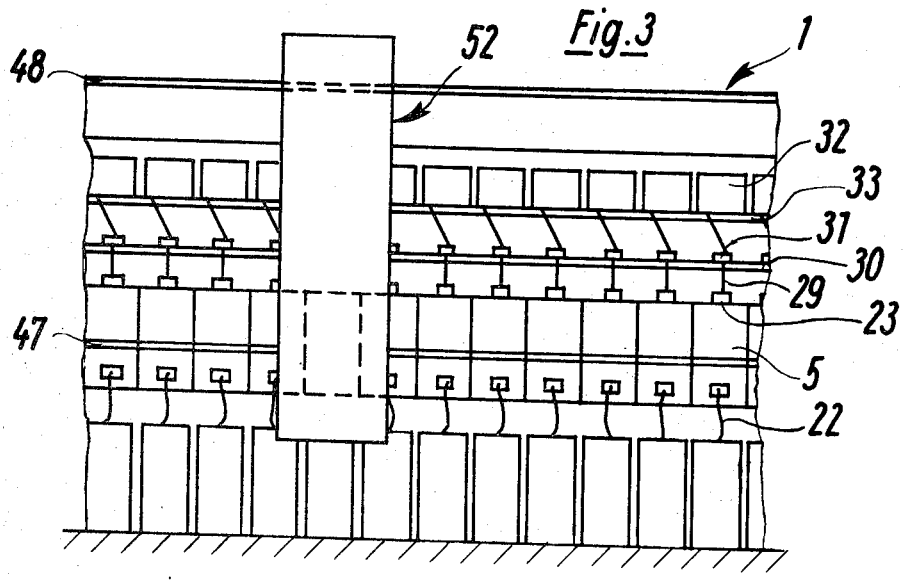
FIG. 3 is a schematic front view of a part of an open-end spinning machine with a mobile piecing device constructed in accordance with the present invention.

FIG. 1 schematically shows the cross section through an open-end spinning machine 1 in the region of a spinning assembly 2, which machine consists of a plurality of like spinning assemblies arranged side by side (see FIG. 3). Each spinning assembly presents essentially three housings 3, 4 and 5, fixed on a machine frame 6. Housing 3 is connected to a vacuum source and receives a spinning rotor 7. Shaft 8 of spinning rotor 7 is borne in housing 4 and is driven by a tangential belt 9. This tangential belt 9 in the operational state is pressed by a pressure roll 10 onto shaft 8, which also carries the return segment 11 of tangential belt 9. In the operational state illustrated in FIG. 1, in which spinning rotor 7 is stopped, the pressure roll 10 is lifted and therewith the driving tangential belt 9 is lifted from rotor shaft 8. Pressure roll 10 is coupled via a link 12 with a brake mechanism 13 which has a brake cheek 14 that in FIG. 1 is presented to rotor shaft 8. Brake mechanism 13 also has a double armed brake lever 15 which is swingable about a stationary shaft 16. In the operational state, rear arm 18 of brake lever 15 will be depressed by a spring 19, whereby brake mechanism 13 will move downward and brake cheek 14 will be lifted from rotor shaft 8. At the same time, because of a coupling of link 12 with brake mechanism 13, pressure roll 10 will be lowered and therewith tangential belt 9 will be applied to rotor shaft 8. The forward arm of brake lever 15 has a contact surface 20 by which the whole brake mechanism can be actuated. On the machine frame 6 there is a stationary shaft 21 about which housing 5 of spinning assembly 2 can be swung away from housing 3. In this way, if need be, spinning rotor 7 can be exposed and made accessible from the outside. Housing 5 which can be swung away contains essentially the feed and opening devices for a sliver 22 that is to be spun, as well as a yarn draw off passage 23. The delivery device in a known way comprises a feed roll 24, a feed table 25 cooperating therewith and under spring pressure, as well as an intake hopper 26 for sliver 22. The sliver 22, running in between feed roll 24 and feed table 25 which is clamped along a nip, offers a sliver beard to a fast running opener roll 27.

Opener roll 27 opens the sliver to individual fibers which are taken via a feed passage 28 to spinning rotor 7 and there are spun to a yarn 29. The spun yarn 29, indicated by a dot-and-dash line, is drawn off by draw off rolls 30 and 31 from yarn draw off passage 23 and wound on a spool 32 which is also indicated by a dot-and-dash line, said spool being driven by a friction roll 33.

The drive of feed roll 24 is effected via a gear 34 that is connected via a shaft 35 with another gear 36 which is engaged with a gear 37. Gear 37 is fixed in rotation with a driven shaft 38 that extends in the long direction of the machine. Between gears 34 and 36 there is an electromagnetic coupling 39 which is connected via an electric line 40 with a yarn monitor 41. Yarn monitor 41 has a yarn sensor 42 which monitors the presence of yarn 29 and in case of a yarn break deflects into position 43. In this case yarn monitor 41 interrupts the drive of feed roll 24 via electromagnetic coupling 39 which, although gear 36 is driven as before, stops gear 34 and therewith feed roll 24. On shaft 35 of the drive for feed roll 24 there is a tapered gear 44 which extends somewhat forward from housing 5, and via which the feed is briefly actuatable, in a way that will be described, during the piecing operation.

On machine frame 6 there are rails 47 and 48, held with supporting arms 45 and 46, extending in the long direction of the machine. On the rails 47, 48, a piecing device 52 can be moved along open-end spinning machine 1, on wheels 49, 50 and 51. The weight of piecing device 52 is preferably accepted by two wheels 49, whereof at least one is driven. Wheels 50 and 51 ensure the horizontal stability of the piecing device 52.

The mobile piecing device 52 comprises means or function elements for the piecing operation, especially for the removal of a yarn break, whereby only a few of these means are represented in FIG. 1. Piecing device 52 has among other things a program control 53 which is connected electrically with the travel mechanism and also with a plurality of individual drives for the individual function elements. One of these couplings comprises an actuating element 54, shown as a lift piston magnet, whose piston 55 can be applied against a lever 56 on piecing device 52, said lever 56 being swingable about a shaft 57. An actuating arm 58 that is connected with lever 56 so as to be fixed in rotation, has a contact surface 59 for actuating the forward contact element 20 of brake mechanism of spinning rotor 7. In the case illustrated in FIG. 1, piston 55 of actuating element 54 is extended and has pushed lever 56 toward the right, whereby contact surface 59 has moved downward. Thereby surface 20 of brake lever 15 is depressed, whereby brake cheek 14 is applied against rotor shaft 8, and moreover tangential belt 9 has been lifted from rotor shaft 8. Spinning rotor 7 is thus temporarily braked. If, controlled by program control 53, piston 55 of actuating element 54 goes back toward the left, from the effect of spring 19 brake lever 15 will again move upward whereby brake 14 will release rotor shaft 8 and tangential belt 9 will again be applied to rotor shaft 8. Actuating element 54, controlled by program control 53, thus triggers the starting time for the running up of spinning rotor 7 as well as the actual piecing process at the same time.

So long as the yarn sensor 42 remains in its inoperative position 43, feed roll 24 is stopped. For this reason, a drive 60 is provided for the mobile servicing instrument 52 which has a tapered gear 61 that can be brought into engagement with the tapered gear 44 of spinning assembly 2 which has already been described. Tapered gear 61 is seated on a shaft 62 which can be temporarily driven by motor 64 that is swingable about shaft 63, said drive preferably being interruptable. In this way, feed roll 24 can be driven by piecing device 52 so long as the yarn sensor is in its inoperative position 43. If piecing device 52 executes no spinning operation, tapered gear 61 is swung outward somewhat toward the top, so that engagement with gear 44 is interrupted.

Servicing instrument 52 further has an auxiliary roll 65, made as a lift-off roll, which is swingable about a shaft 66. Auxiliary roll 65 can be presented against spool 32 from below and lift it with a spool holder 68 from the friction roll 33 into a raised position 67. Spool holder 68 is swingable about a shaft 69 that is fixed to the machine. Auxiliary roll 65 is disposed on a lever 70 that has a swing drive, which lever presents a feed roll 71 on its pivot shaft 66, which roll 71 can be driven synchronously in either direction with auxiliary roll 65. Feed roll 71 cooperates with a second feed roll 72 which is made as a pressure roll, said roll 72 being swingable into a lifted position 75 via a lever 73 about a shaft 74, by means of a swing drive. The said raised position 75 makes it possible to insert the yarn end 76 that is to be wound off from lifted spool 67 and then transferred via a path between feed rolls 71, 75, by means of a swingable suction device that is not illustrated to a position accommodating piecing. Feed roll 75 then assumes position 72, whereby the yarn end 76 that is to be pieced and is therewith guided into servicing instrument 52 can be delivered to yarn draw off passage 23. This occurs with cooperation of a yarn transfer clamp 77 whose pivot arm 78 is rotatable about a shaft 79. Yarn transfer clamp 77 can be swung along the radius 80 which is indicated with dashed lines. A common drive is preferably provided for auxiliary roll 65 and feed roll 71, e.g. a chain drive with an electric motor, so designed that the auxiliary roll 65 will have a slightly greater peripheral speed at its surface that guides the yarn or spool 67.

Before yarn end 76 is guided back into spinning rotor 7 and can again be drawn off as newly spun yarn, a ring of sliver has to be deposited in spinning rotor 7, to which yarn end 76 will be applied. The production of this sliver ring is controlled by the drive 60 of piecing device 52 during the piecing, and maintained until the yarn sensor of yarn monitor 41 assumes its operative position and thereby switches in the device for delivery of sliver in the spinning assembly 2 in question. Piecing device 52 generally has also a number of other function elements whereby the yarn end that is led back is prepared before the actual piecing operation and thereby there follows a controlled transfer of the yarn that is again drawn off, to the spinning assembly. Program control 53 of mobile piecing device 52 determines the succession and course of the individual process steps that are necessary for the piecing, until the yarn finally is transferred again to the spinning assembly.

Open-end spinning machines generally are of such construction that the spinning rotors can be braked independently of the spinning rotors of the adjacent assemblies. It therefore suffices for the whole intervention of piecing device 52 that there be provision of the possibility of actuating the brake mechanism of spinning rotor 7 and that sliver feed be taken over for a specific time via drive 60.

To facilitate the piecing, during the running up of spinning rotor 7, a sliver ring is already deposited in the motor, which is effected by the feed of sliver 22 under the control of piecing device 52. This feed can only occur when the spinning rotor has reached a minimum rpm, because otherwise the centrifugal force acting on the fibers inside the spinning rotor would not be sufficient to hold the fibers against the suction flow inside rotor housing 3. During the running up (acceleration of the rotor), for the same reason moreover, the presentation of the yarn end to the sliver ring and its subsequent drawing off again as newly spun yarn is effected. Both processes are also controlled by program control 53, whereby the presentation of the yarn end to the sliver ring occurs after a predetermined time, while the drawing off is controlled as a function of time, or by a yarn sensor disposed in the path of the yarn of the piecing device 52.

In the drawing off of the yarn, which occurs shortly after the situation that is illustrated in FIG. 1, feed rolls 71, 72, the auxiliary roll 65 and yarn spool 67 must change their direction of rotation and within a relatively short time reach the normal operational speeds of the spinning assembly. Here there is a slippage between yarn spool 67 and auxiliary roll 65, caused by the inertia of spool 67, while feed rolls 71, 72 transport the practically massless yarn 76 almost without delay, at the necessary draw off speed. Because of the differences in feed speed and winding speed, a yarn loop forms between feed rolls 71, 72 and auxiliary roll 65, which usually, because of the twist in the yarn, kinks up and is then wound as a kink on spool 67.

To avoid the described risk of formation of a kink and the winding of this kink onto spool 67, the present invention contemplates two solutions or part solutions, namely, it may be provided on the one hand that the slippage between auxiliary roll 65 and spool 67 will be diminished, while it is possible on the other hand so to guide and tension the developed yarn loop so that formation of a kink is excluded. Of course it is contemplated by the invention to use the respective measures in isolation but in practice it is surely often advisable to combine them according to the most preferred embodiments of the invention. In this way, on the one hand the yarn loop will not be excessively big, and on the other hand the load on spool 67 will not increase excessively. Depending upon the design of the machine, the present invention contemplates various possibilities for managing the yarn loop. Thus the speed of auxiliary roll 65 can be slightly higher than that of feed rolls 71, 72, or the speed of friction roll 33 can be higher than that of feed rolls 71, 72, whereby the loop in the latter case will then be eliminated if spool 32 is again driven by friction roll 33 and the yarn is still delivered from rolls 71, 72. The invention also contemplates the possibility of eliminating the loop only after the yarn has been transferred to the machine.

Figure 2:
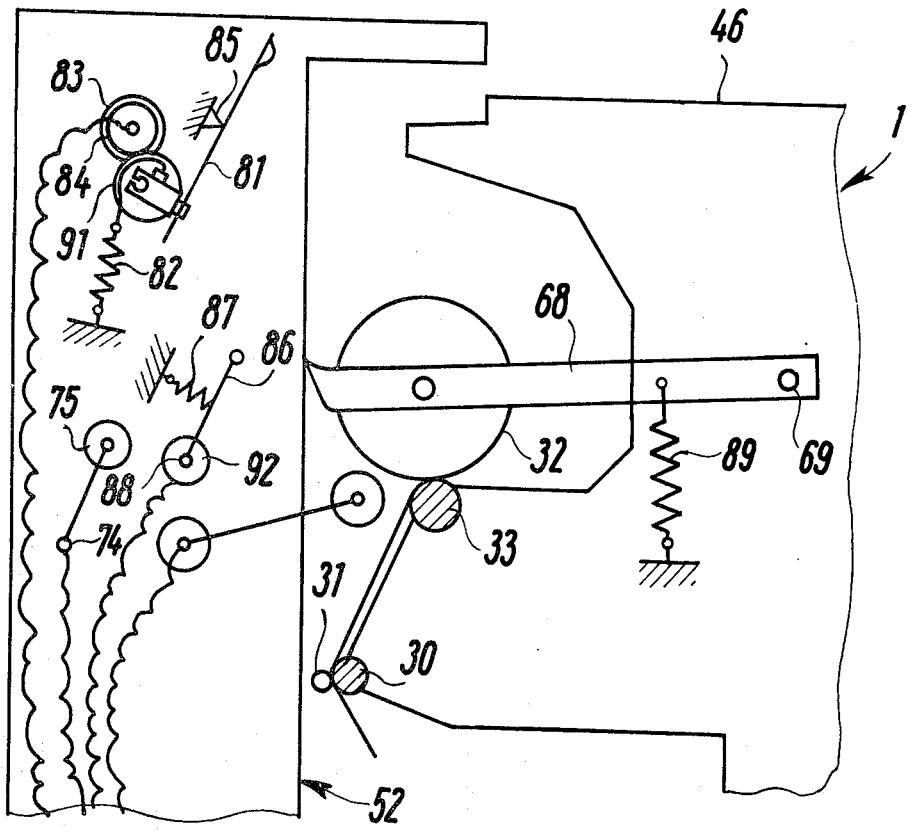
FIG. 2 is a partial schematic view of portions of the FIG. 1 embodiment and showing the piecing device in its inoperative position.

In the embodiment according to FIGS. 1 and 2 there is a loading device which applies spool 67 with reinforced pressure against auxiliary roll 65 during the running up phase, i.e. when the pieced yarn is again drawn off after its presentation to the sliver ring, and thus the possible slippage is reduced. The loading device has a leaf spring 81 that engages with a pressure piece on spool holder 68, at the other end of which leaf spring a holder is clamped that is fixed in rotation with a plate 91. Plate 91 can be driven clockwise via a friction wheel 84 by means of a drive motor 83, in such a way that the pressure piece of the leaf spring will be applied on spool holder 68 from above. In this way, by means of drive motor 83, there will be a precisely determined torque that will lead to a precisely determined loading force with which spool 67 will be additionally pressed against auxiliary roll 65. Instead of a friction wheel 84 and a plate 91 there may also be provision of two gears, whereby then for example gear 84 will be connected with drive motor 83 via a slide coupling. The time of switching in and the duration of the switching in of the loading device, i.e. of motor 83, is determined by the central program control 53. When the drive motor 83 is cut off, then a tension spring 82 joined to plate 92 pulls leaf spring 81 back into the inoperative position illustrated in FIG. 2. The loading device can be switched in by the program control 53 at the same time as the start of the drawing off of the yarn. The duration of the switching in is advantageously determined according to a pragmatic value which is directed according to the mass that a spool with maximum filling has. The same applies for the arrangement of the loading force which can also be measured out by the program control 53.

To prevent the formation of an unguided yarn loop between feed rolls 71 and 72 and auxiliary roll 65, a yarn storage device is additionally provided, which guides the yarn in the zone between feed rolls 71, 72 and auxiliary roll 65. In FIGS. 1 and 2 such a yarn storage device is shown in its simplest embodiment. In this case it comprises an arcuate member 86 which is loaded in the direction toward yarn 76 with a spring 87, which is swingable about a shaft 88 in such a way that it deflects yarn 76 between feed rolls 71, 72 and auxiliary roll 65. If the yarn tension in the region between feed rolls 71, 72 and auxiliary roll 65 drops because of a difference between feed velocity and winding speed, there is then a yarn deflection by means of arcuate member 86. When the final winding speed is reached, which is slightly greater than the feed velocity, the loop is again eliminated, whereby arcuate member 86 swings back into the position shown in FIG. 1. The movement of arcuate member 86 can be utilized as a signal with which other work processes in the piecing device 52 are controlled. For example, it is contemplated to dispose a signal transmitter in the swing shaft 88, which is connected with program control 53 and which gives a signal to program control 53 that is dependent upon the deflection of arcuate member 86. With use of this signal, for example, the duration of the switching on time of the loading device of spool holder 68 can be determined. It is also possible to use the signal of arcuate member 86 to trip the start of the transfer means which is not illustrated, wherewith the running yarn is transferred to spinning assembly 2. As FIG. 2 shows, arcuate member 86 can be deflected by a drive 92 controlled by the program control, into an inoperative position in which it is not disposed in the region of the yarn path. This reliably excludes its hindering the drawing off of the yarn from spool 67 and the insertion in feed rolls 71, 72.

It can further be provided that arcuate member 86 may be presented to the running yarn even in the redelivery of the yarn end. If auxiliary roll 65 works with a slightly greater wind off speed than the feed rolls, even in the winding off there is a loop formed in the region between feed rolls 71, 72 and auxiliary roll 65. The length of yarn in this loop can be utilized for example for the subsequent piecing process to the extent that therewith the yarn length will be established that is needed to present the yarn end to the sliver ring present in spinning rotor 7. This would have the advantage that at least the drive of auxiliary roll 65 and therewith of spool 67 for the subsequent drawing off can run up from a stop and will not need to be reversed.

Figures 4, 5, 6, 7:
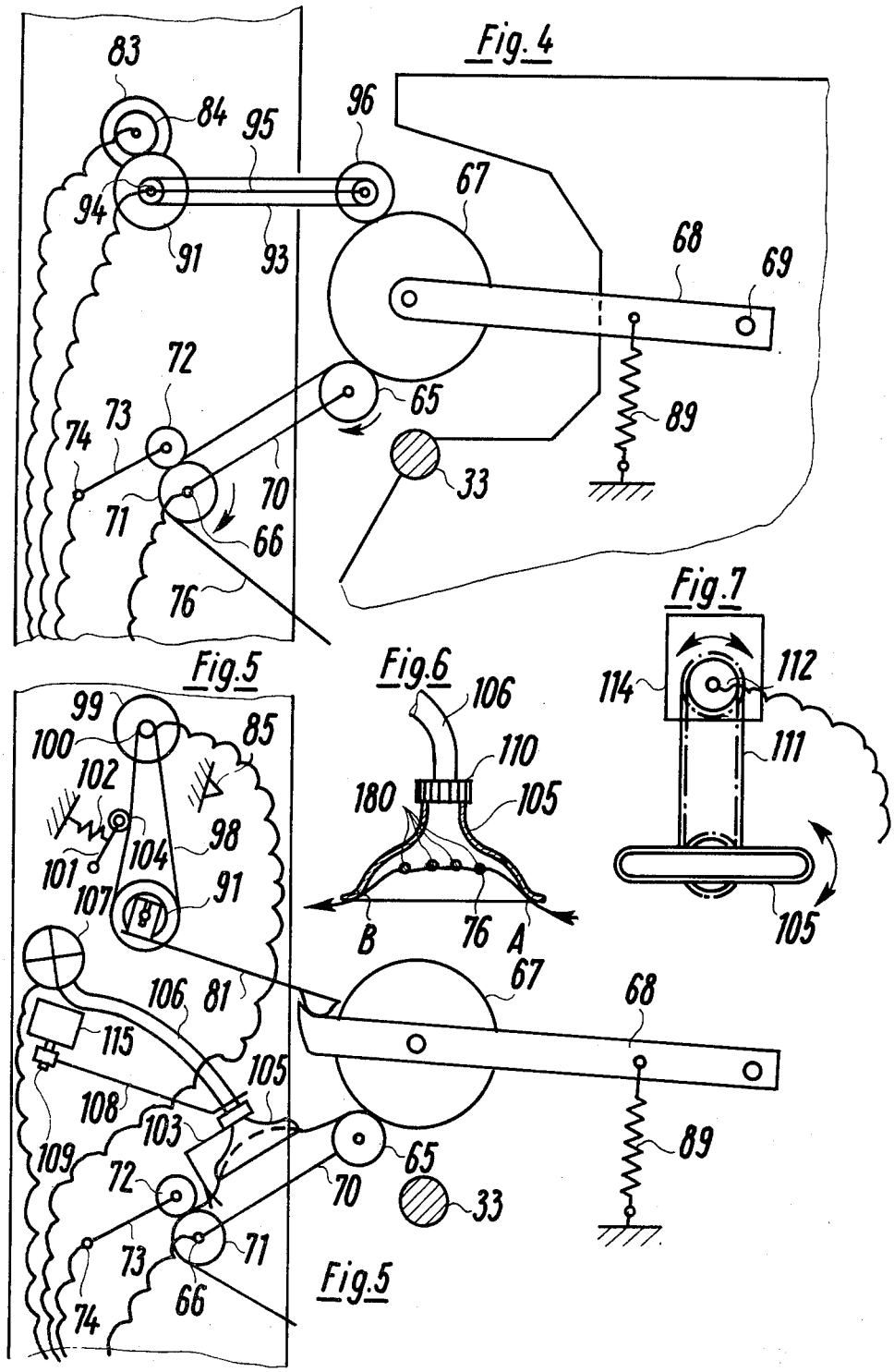
FIG. 4 is a partial schematic view, showing another preferred embodiment of the invention.
FIG. 5 is a partial schematic part sectional view showing another embodiment of the invention.
FIG. 6 is a partly broken away view of a detail of FIG. 5.
FIG. 7 is a further view of the detail according to FIG. 6.

In the embodiment according to FIG. 4, a pressure roll 96 serves as loading device, pressing spool 67 against auxiliary roll 65, supplementing a tension spring 89 that engages the spool holder 68. Pressure roll 96 is disposed on the free end of an arm 95 that is swingable about a shaft axis 94. Arm 95, like the form of embodiment according to FIGS. 1 and 2, is driven by means of an electric motor 83, a friction wheel 84 and a plate 91. In this embodiment it is indicated that the electric motor 83 can be driven in both directions of rotation so that it can effect the presentation and also the lifting off of pressure roll 96, depending upon the control signals of the central program control. It can be provided in this embodiment that pressure roll 96 will be provided with its own drive 93 which can exert a supplementary drive moment on spool 67 during the running up phase. Thereby not only will the slippage between spool 67 and the auxiliary roll 65 be reduced, but a supplementary drive moment will be exerted on spool 67 which supports the fast running up of the spool 67 to operational speed. It can be provided here that the pressure roll 96 will be driven with a higher peripheral speed, as opposed to the peripheral speed of auxiliary roll 65.

The embodiment according to FIG. 5 shows a loading device for the spool holder 68 which corresponds in principle to the embodiment according to FIG. 1. The leaf spring 81, provided with a pressure piece, is connected so as to be fixed in rotation with a plate 91 which in this embodiment is driven by a belt 98. Belt 98 is slung about the drive plate pin 100 of an electric motor 99, which is controlled by the central program control. Belt 98 is additionally tensioned by a lever 101 and a tension roll 104 loaded by a spring 102. In this form of embodiment it is possible to limit the loading force by the possibility of force transmission between belt 98 and plate 91 or between belt 98 and pin 100. Since this force transmission depends upon the tensioning of the belt, it is also possible to measure out the loading force by changing the belt tension. In some situations loading spring 102 can also be replaced by a setting element that applies a specific loading force as controlled by the central program control, which can depend upon values determined on the running of the yarn or even upon the diameter of spool 67.

In the embodiment according to FIG. 5 there is also a yarn storage between feed rolls 71, 72 and auxiliary roll 65, in the form of a suction nozzle 105 directed to the course of the yarn. Suction nozzle 105 is connected via a suction line 106 and a valve 107 to a vacuum source of the piecing device which is not illustrated. Valve 107 is actuated by the central program control, to guide a yarn loop that forms because of the differences in winding speed and feed velocity. Suction nozzle 105 is held on the free end of an arm 108 which can be swung by a drive 115 about a shaft 109 in such a way that the suction nozzle 105 will be moved crosswise with reference to the direction of the running of the yarn. If arm 108 is moved about shaft 109, then the running yarn will be transferred onto auxiliary roll 65 so that a superimposition of several windings of the newly pieced yarn at the same place on spool 67 will be avoided. There is a centering device on suction nozzle 105 which guides yarn 76 in such a way that it can be engaged by the suction nozzle 105. In the illustrated embodiment an arcuate wire with a fork serves as centering device 103.

A suction nozzle 105 advantageously preferably presents a long slitlike configuration and extends in the running direction of yarn 76. To prevent a kink from forming on the yarn in the region of suction nozzle 105, it is advantageous if there are other guide elements inside suction nozzle 105, for instance transverse rods 180 as in FIG. 6. The yarn friction at both ends A and B of suction nozzle 105 has the effect that even within the suction nozzle the yarn will be held under sufficient tension.

The suction nozzle can also have another task, namely in case of a yarn break between the winding spool and the draw off roll shortly after the piecing operation, to suction off the loose piece of yarn that is produced, and deliver it to a waste collecting station. In this way it is prevented that such a piece of yarn would wind onto the draw off roll, fall down onto the receiving belt or make trouble somewhere else that would cause failures in subsequent piecing attempts. If the piece of yarn is suctioned off, the second piecing operation can run without trouble.

FIG. 7 shows a modification whereby, with use of suction nozzle 105, there can be a kind of change movement for the yarn. With this embodiment it is provided that the suction nozzle will be held rotatably about a middle shaft that is transverse to the direction of running of the yarn. It is driven in a reciprocating motion by a belt or chain 111, via a drive wheel 112 of a drive motor 114, which is switched on or off by the central program control.

Figure 8:
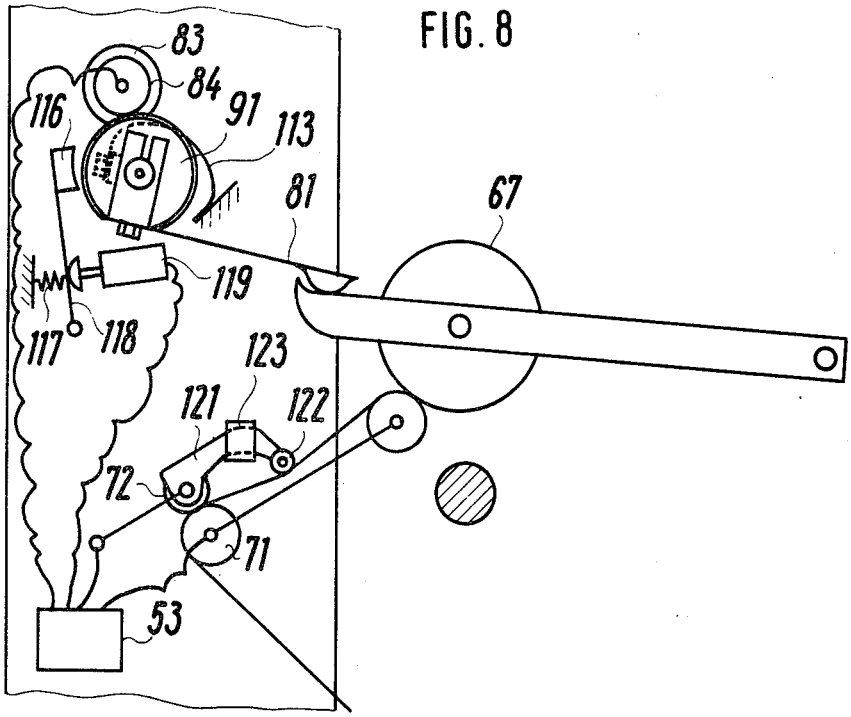
FIG. 8 is a partial schematic part sectional view through a further embodiment with a weight-loaded yarn storage.

In the embodiment according to FIG. 8, a loading device is provided which presents a leaf spring 81 with a pressure piece that acts on spool holder 68. The end of the leaf spring is fixed in rotation, via a holder, with a plate 91 which is driven in a way that corresponds to that of the embodiment of FIG. 1, by an electric motor 83 via a friction wheel 84. The holder is also loaded with a torsion spring 113. In this embodiment it is provided that the torsion spring 113 will determine the loading force and apply the leaf spring 81 with its pressure piece against the spool holder 68. The electric motor which is controlled by program control 53 serves to move plate 91 and leaf spring 81 back into the starting position. In this starting position, the leaf spring is held by a brake cheek 116 that engages plate 91, so that the electric motor can be switched off when it has brought the loading device into the inoperative position. Brake lining 116 is disposed on a swing lever 118 which can be swung against the force of a spring by means of a servo member 119 that is actuated by central program control 53. Servo member 119 serves to lift brake lining 116 from the plate during the running up phase. In this way, the loading force on the spool holder or the force of application of the spool 67 against auxiliary roll 65 can be very rapidly brought to the desired degree.

A balancing arcuate member 121 is provided as yarn storage device in the embodiment according to FIG. 8, disposed on the shaft of feed roll 72 which is made as a pressure roll. The balancing member has a loading weight 123 and at its free end it is provided with a very lightly threaded roll 122. The friction of the yarn on the threaded roll 122 is sufficient to set said roll into rotation so that the yarn then running along the groove will be transferred axially to the auxiliary roll and to the spool 67.

Figure 9:
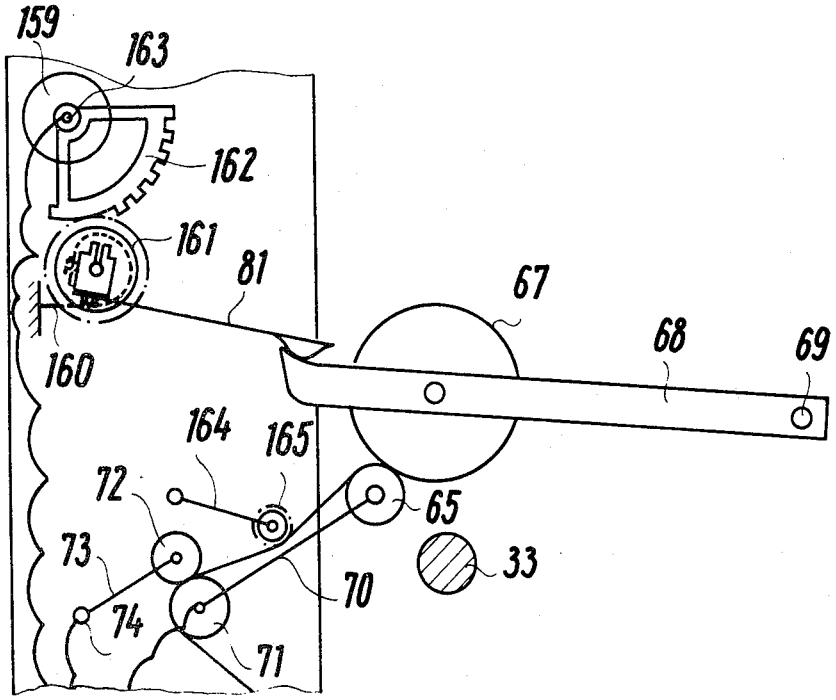
FIG. 9 is a partial schematic part sectional view of a piecing device constructed according to a further embodiment of the invention, with a mechanical drive for a loading device of a spool holder.

In the embodiment according to FIG. 9 the loading device for spool holder 68 is again a leaf spring 81 that is applied to the spool holder with a pressure piece, said spring being connected so as to be fixed in rotation via a holder, with a shaft and a gear 161. A torsion spring 160 acts on the shaft or on the leaf spring 81 so that thereby the loading forces are produced. Gear 161 is associated with a gear segment 162 which can be turned by a drive motor 159 controlled by the central program control, about a shaft 163 to tension torsion spring 160 and to transfer the loading device into the inoperative position. When the segment 162 is disengaged from gear 161, the desired loading force can be produced very rapidly. In the embodiment according to FIG. 9, as in the embodiment according to FIG. 1, a balancing arcuate member 164 with a lightly threaded roll 165 is provided as yarn storage, which is provided with a spring or weight loading in a way that is not described in more detail.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A piecing device for an open-end spinning machine of the type having a plurality of spinning assemblies which each include a rotatable storage spool for storing yarn as it is spun at said spinning assembly, spool drive means for driving said spool during spinning operations, and yarn guide means for guiding the yarn between the rotor of the spinning assembly and the spool during spinning operations; said piecing device comprising:

auxiliary spool drive means for driving the spool at a spinning assembly during piecing operations at said spinning assembly, auxiliary yarn guide means for guiding the yarn between the spool and a yarn outlet of a spinning rotor of the spinning assembly during piecing operations, said auxiliary yarn guide means including auxiliary driven feed means for said yarn, and control means for controlling the course of the yarn between the auxiliary driven feed means and the spool so as to reduce formation of a loop in the yarn during acceleration of the drawing off of the yarn during piecing.

2. A device according to claim 1, wherein said auxiliary driven feed means includes a pair of feed rolls through which the yarn passes, and wherein the drive for said feed rolls is synchronized with the auxiliary spool drive means.

3. A device according to claim 2, wherein said auxiliary spool drive means includes a driven auxiliary roll drivingly engageable with said spool.

4. A device according to claim 3, wherein said device is mobile and is selectively operable to perform piecing operations at respective individual spinning assemblies of the spinning machine.

5. A device according to claim 3, wherein the control means includes a yarn storage device disposed between the pair of feed rolls and the auxiliary roll, which during the running up phase takes up yarn that is delivered during the running up phase and not wound, in case of differences between feed velocity and winding speed.

6. A device according to claim 5, wherein the yarn storage has a deflecting element to produce a deflection of the course of the yarn, in which the yarn is guided with maintenance of a given yarn tension.

7. A device according to claim 6, wherein the nozzle acts as the deflecting element.

8. A device according to claim 6, wherein a swingable arcuate member in the course of the yarn, between the feed roll pair and the auxiliary roll serves as deflecting element.

9. A device according to claim 2, wherein the control means includes means for influencing the running path of the yarn in the zone between the feed rolls and the spool.

10. A device according to claim 2, wherein the control means includes means for influencing the winding speed of the spool.

11. A device according to claim 10, wherein the control means are connected to a program control that controls the whole work sequence of the piecing device, said program control determining the time of switching in and/or the duration of the switching in or the like.

12. A device according to claim 11, wherein the control means includes a loading device which presses the spool on the auxiliary roll during the running up phase.

13. A device according to claim 12, wherein the loading force and/or the duration of load of the loading device is controlled by the central program control.

14. A device according to claim 13, wherein a pressure roll is provided as loading device which is selectively engageable with the spool at a position advantageously diametrically disposed with reference to the auxiliary roll.

15. A device according to claim 13, wherein the loading device is selectively engageable with a spool holding device holding said spool.

16. A device according to claim 15, wherein the loading device presents a pressure member that is spring-loaded in the direction of the spool holder and that is held in an inoperative position by a lock device that is releasable by the program control.

17. A device according to claim 11, wherein the control means includes a yarn storage device disposed between the pair of feed rolls and the auxiliary roll, which during the running up phase takes up yarn that is delivered during the running up phase and not wound, in case of differences between feed velocity and winding speed.

18. A device according to claim 17, wherein the storage capacity and/or the duration of the switching in of the yarn storage is controlled by the central program control.

19. A device according to claim 18, wherein the yarn storage has a deflecting element, to produce a deflection of the course of the yarn, in which the yarn is guided with maintenance of a given yarn tension.

20. A device according to claim 19, wherein the nozzle acts as the deflecting element.

21. A device according to claim 19, wherein a swingable arcuate member in the course of the yarn, between the feed roll pair and the auxiliary roll serves as deflecting element.

* * * * *